US008602044B2

(12) United States Patent
Zemitis

(10) Patent No.: US 8,602,044 B2
(45) Date of Patent: Dec. 10, 2013

(54) TENT ASSEMBLY

(75) Inventor: Martin S. Zemitis, Berkeley, CA (US)

(73) Assignee: Slingfin, Inc., Berkeley, CA (US)

( * ) Notice: Subject to any disclaimer, the term of this patent is extended or adjusted under 35 U.S.C. 154(b) by 27 days.

(21) Appl. No.: 13/188,406

(22) Filed: Jul. 21, 2011

(65) Prior Publication Data

US 2012/0017955 A1 Jan. 26, 2012

Related U.S. Application Data

(60) Provisional application No. 61/366,921, filed on Jul. 22, 2010.

(51) Int. Cl.
*E04H 15/36* (2006.01)
*E04H 15/42* (2006.01)

(52) U.S. Cl.
USPC ..... 135/124; 135/156; 135/906

(58) Field of Classification Search
USPC ..... 135/116, 124, 125, 127, 156, 95, 97, 135/906
See application file for complete search history.

(56) References Cited

U.S. PATENT DOCUMENTS

| | | | | |
|---|---|---|---|---|
| 4,265,259 | A * | 5/1981 | Gillis | 135/127 |
| 4,269,210 | A * | 5/1981 | Marks | 135/125 |
| 4,709,718 | A * | 12/1987 | Nichols | 135/125 |
| 4,945,584 | A * | 8/1990 | LaMantia | 5/97 |
| 5,072,694 | A * | 12/1991 | Haynes et al. | 119/482 |
| 5,080,119 | A * | 1/1992 | Scherer | 135/127 |
| 5,117,852 | A * | 6/1992 | Bryant | 135/125 |
| 5,197,504 | A * | 3/1993 | Howe | 135/127 |
| 5,370,145 | A | 12/1994 | Wu | |
| 5,421,355 | A * | 6/1995 | Cantwell | 135/120.3 |
| 6,145,527 | A | 11/2000 | Gillis | |
| 6,371,143 | B1 * | 4/2002 | Swetish | 135/125 |
| 6,415,806 | B1 * | 7/2002 | Gillis | 135/124 |
| 8,001,986 | B2 * | 8/2011 | Shumate | 135/116 |
| 2006/0201104 | A1 | 9/2006 | Hallett et al. | |
| 2007/0095377 | A1 | 5/2007 | Poulson | |
| 2008/0196755 | A1 * | 8/2008 | Cheng | 135/126 |

OTHER PUBLICATIONS

International Search Report PCT/US2011/044874 dated Feb. 24, 2012, pp. 1-4.
Written OpinionPCT/US2011/044874 dated Feb. 24, 2012, pp. 1-5.

* cited by examiner

*Primary Examiner* — Noah Chandler Hawk
(74) *Attorney, Agent, or Firm* — Perkins Coie LLP

(57) ABSTRACT

Disclosed are structures and methods of assembling and positioning an improved tent assembly where members of the assembly use flexible hollow sleeve structures with integral fabric hub intersections that are held in tension in combination with compression members that can be used for a variety of applications. Disclosed techniques make assembling tent assemblies significantly easier than known prior art since the intersecting flexible hollow sleeve structures can be made continuous. In addition, the improved tent assembly is significantly stronger when deployed with compression members because the hollow sleeve structures, with integral fabric hub intersections, can be tensioned, thus significantly increasing the strength of the overall structure.

19 Claims, 21 Drawing Sheets

TENT ASSEMBLY

PRIORITY CLAIM

This patent application claims priority to U.S. Provisional Patent Application No. 61/366,921, entitled "Flexible Hollow Sleeve Frame Support Structure with Integral Fabric Hub Intersections," filed Jul. 22, 2010, which is incorporated herein in its entirety.

FIELD OF INVENTION

The present invention generally relates to tent constructions, and more specifically, to an improved tent assembly that can easily be erected by a user, where the improved tent assembly uses a web truss for providing an internal frame structure, where the web truss is a flexible hollow sleeve frame support structure with integral fabric hub intersections.

BACKGROUND OF THE INVENTION

Tents of conventional construction are typically time-consuming to erect. For example, tents with conventional internal frames require substantial effort by more than one person to place all the poles in position and then build a tent body around the pole structures. Some prior art tent assemblies allow for tent bodies to have provisions for pole structures to enable ease of construction. However, even in such tent assemblies, it is difficult to enable the tent body to form a certain structure without provisioning additional poles within the tent assembly. Moreover, given the number of poles that need to be erected to provide frame support on each side of the tent assembly, users have to hassle with dealing with a large number of poles during the assembly of the tent. Also, when erecting prior art tent assemblies, a fly sheet and/or tent body has to be added to the tent assembly to provide adequate structural integrity to the tent assembly. Attaching fly sheets or tent bodies is particularly challenging in high wind conditions. Several other such disadvantages exist in prior art necessitating a need for an improved tent assembly. Overall, the examples herein of some prior or related systems and their associated limitations are intended to be illustrative and not exclusive. Other limitations of existing or prior systems will become apparent to those of skill in the art upon reading the following Detailed Description.

SUMMARY OF THE DESCRIPTION

In at least one embodiment, the techniques described herein relates to a structure and method of assembling and positioning compression members using a singular or plurality of flexible hollow sleeve structures with integral fabric hub intersections that are held in tension in combination with compression members that can be used for a variety of applications. The present invention makes assembling structures significantly easier than known prior art since the intersecting flexible hollow sleeve structures can be made continuous. This allows users to erect the structure without the need for additional help. In addition, the improved tent assembly discussed herein is significantly stronger when deployed with compression members because the hollow sleeve structures, with integral fabric hub intersections, can be tensioned, thus significantly increasing the strength of the overall structure.

In embodiments, a further advantage of the improved tent assembly includes ease of assembly in, for example, high wind conditions. The web truss of the disclosed tent assembly may be set up merely with the tent poles without a need for a flysheet and/or a tent body. The pole sleeves of the web truss may be tensioned merely using provisions of the web truss it self, at which time the tent assembly is at full strength even before the flysheet and/or tent body is added. In embodiments, the tent assembly achieves complete structural integrity when the web truss is fitted with the poles. In prior art, since poles are added to the tent body or flysheet one at a time, high wind conditions often damage (e.g., snap) the poles and damage the tents, especially because complete structural integrity of the tent is not attained until the tent is fully erected with all tent poles in position.

In at least these respects, the improved tent assembly discussed here substantially departs from the conventional concepts and designs of the prior art. Other advantages and features will become apparent from the following description and claims. It should be understood that the description and specific examples are intended for purposes of illustration only and not intended to limit the scope of the present disclosure.

BRIEF DESCRIPTION OF DRAWINGS

These and other objects, features and characteristics of the present invention will become more apparent to those skilled in the art from a study of the following detailed description in conjunction with the appended claims and drawings, all of which form a part of this specification. In the drawings:

DETAILED DESCRIPTION OF THE INVENTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

Figure 1:
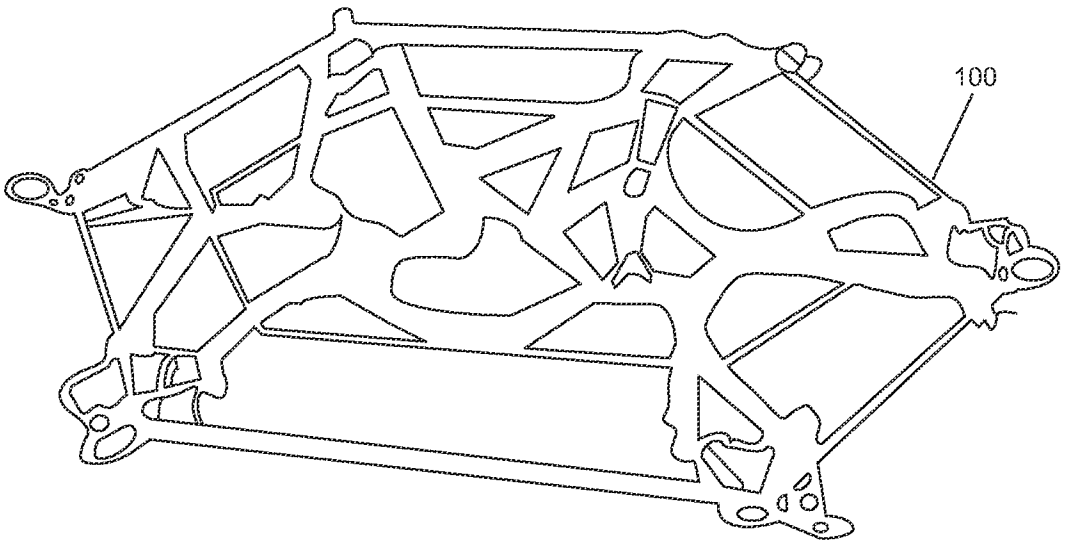
FIGS. 1 to 6 illustrate examples of pitching an improved test assembly.

FIGS. 1 to 6 illustrate examples of pitching an improved test assembly. FIG. 1 depicts an exemplary embodiment of a flexible hollow pole sleeve structure 100. The overall web of sleeve structures may sometimes be referred to herein as a web truss. Such a web truss provides the basic framework allowing a user to build a tent assembly frame, as will be explained in detail herein.

Figure 2:
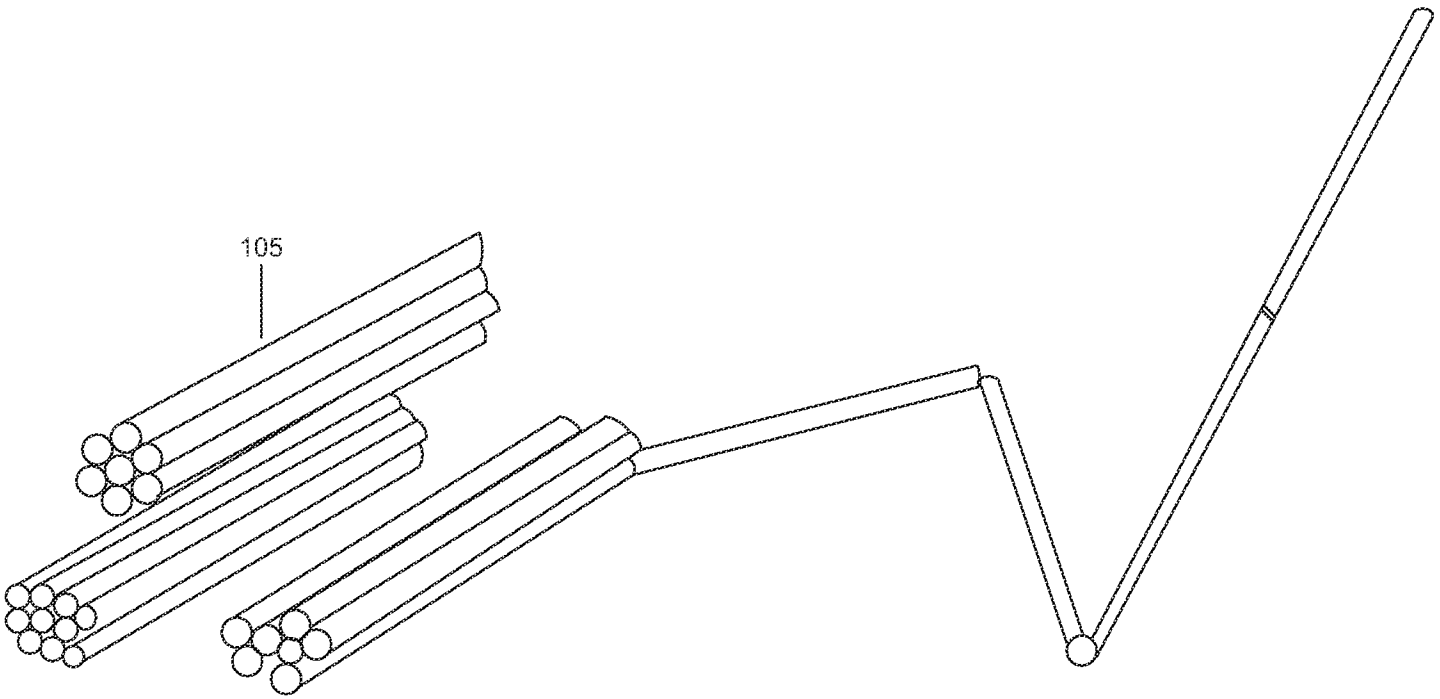
Figure 3:
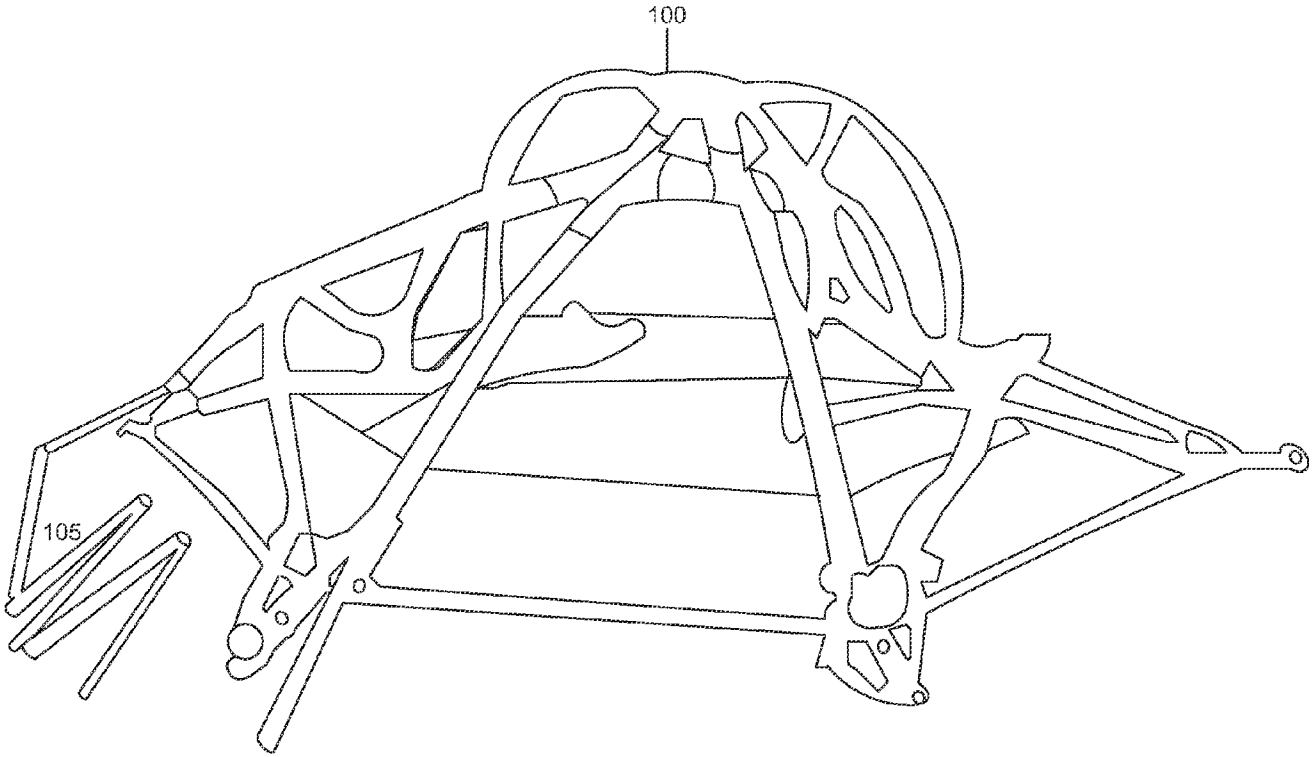
Figure 4:
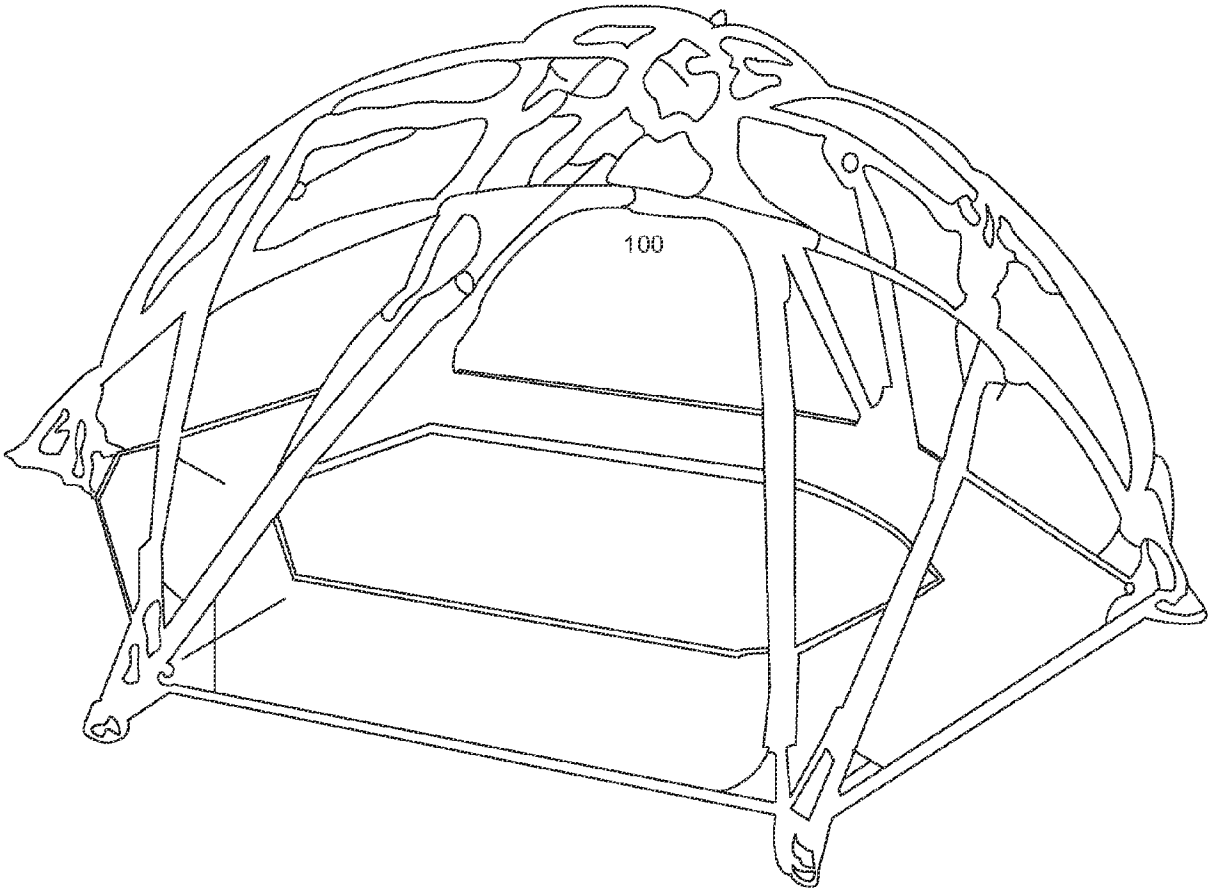

FIG. 2 illustrates examples of tent poles (or simply, "poles") 105 used in conjunction with the improved tent assembly. In embodiments, the tent poles 105 are segmented and are held together with special elastic cord such as a shock cord. FIG. 3 illustrates an exemplary procedure for sliding in or directing poles within the web truss. As illustrated in FIG. 3, a first tent pole 105 is inserted into the opening of one of the flexible hollow pole sleeve structures 100. It is noted that while some of these exemplary figures show equal length tent poles fully inserted in the flexible hollow pole sleeve structure 100, it is envisioned that non-equal poles may also be used as required in a particular application.

Figure 5:
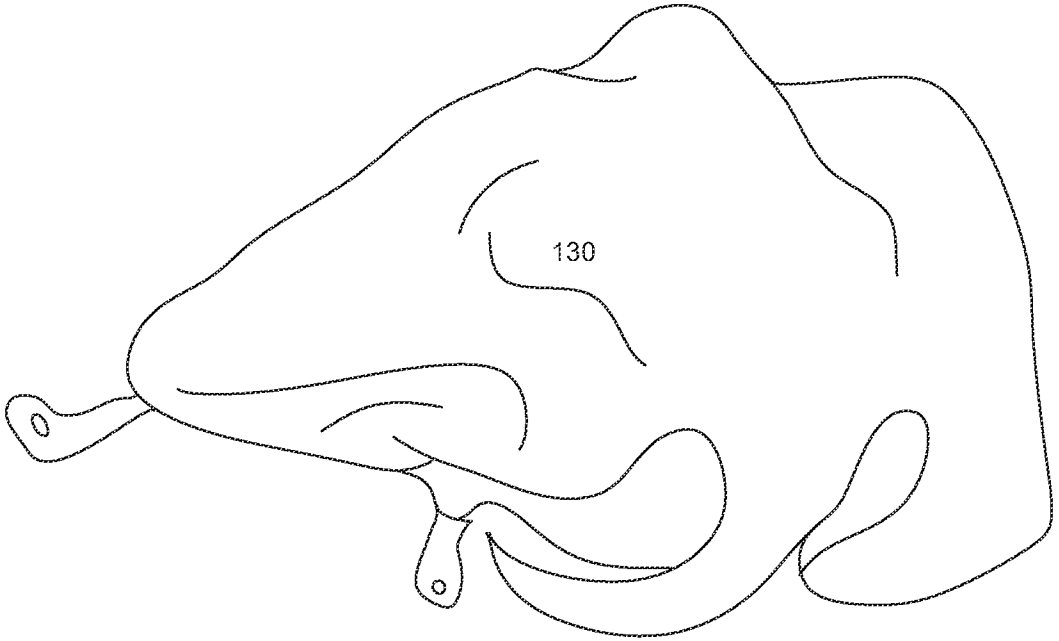

FIG. 5 illustrates an embodiment of an improved tent assembly where a water resistant or waterproof flysheet 130 is placed over the flexible hollow pole sleeve structure 100 to form a weatherproof enclosure. It is noted that the improved tent assembly can be configured to form a frame with either a flysheet or a tent body (that is internal to the frame formed by the web truss) as will be discussed further below. It is important to note that the frame, enabled by the insertion of the tent poles within the sleeve structures of the web truss, is independent of and does not require either for fly sheet or the tent body for completion of formation of a structurally complete structure for use as a tent. In contrast, all known prior art tent assemblies utilize either a fly sheet or a tent body as an essential component of formation of the eventual frame structure of a tent assembly.

Figure 6:
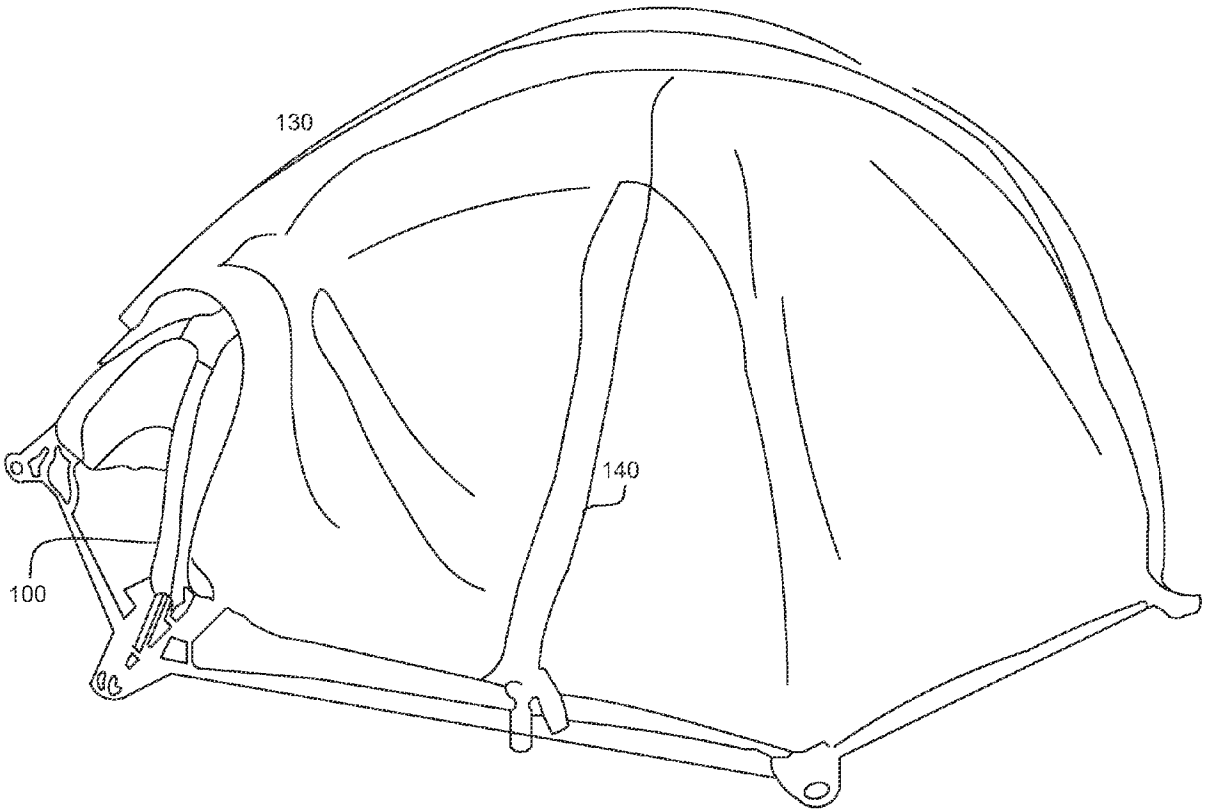

FIG. 6 illustrates an embodiment of the improved tent assembly where a flysheet is partially draped over the flexible hollow pole sleeve structure 100. A zipper 140 entrance on the flysheet allows for user ingress and egress. FIGS. 1 through 6 discussed an exemplary embodiment of an improved tent assembly where multiple poles were used in conjunction with multiple pole sleeves of a web truss in order to create a frame structure that formed the improved tent assembly. While the exemplary figures illustrate the use of as many as 6-12 web hubs (or fabric hubs) that provide housing for pole intersections, it is understood that a frame may be formed using a web truss that has even a single fabric hub. In such an embodiment, two poles may be used to intersect within the fabric hub and still be able to provide support to form a structurally sound frame. In the disclosed embodiments, as can be evidenced from the supporting figures, the improved tent assembly allows for continuous feeding and insertion of tent poles from just one end or base of the web truss. The tent pole extends all the way out to the other end. Issues are normally encountered when two tent poles need to cross over or intersect each other. In such scenarios, the web hubs of the disclosed improved tent assembly has separate angled housing that, as discussed herein, allows the two intersecting tent poles to slide through without allowing the two to collide with each other. This enables a user to simply feed in the poles from just one end of the web truss, while the pole sleeves and the web hubs cause the tent poles to be slid through in a direction and structure so as to form the entire frame of the improved tent assembly.

Figure 7:
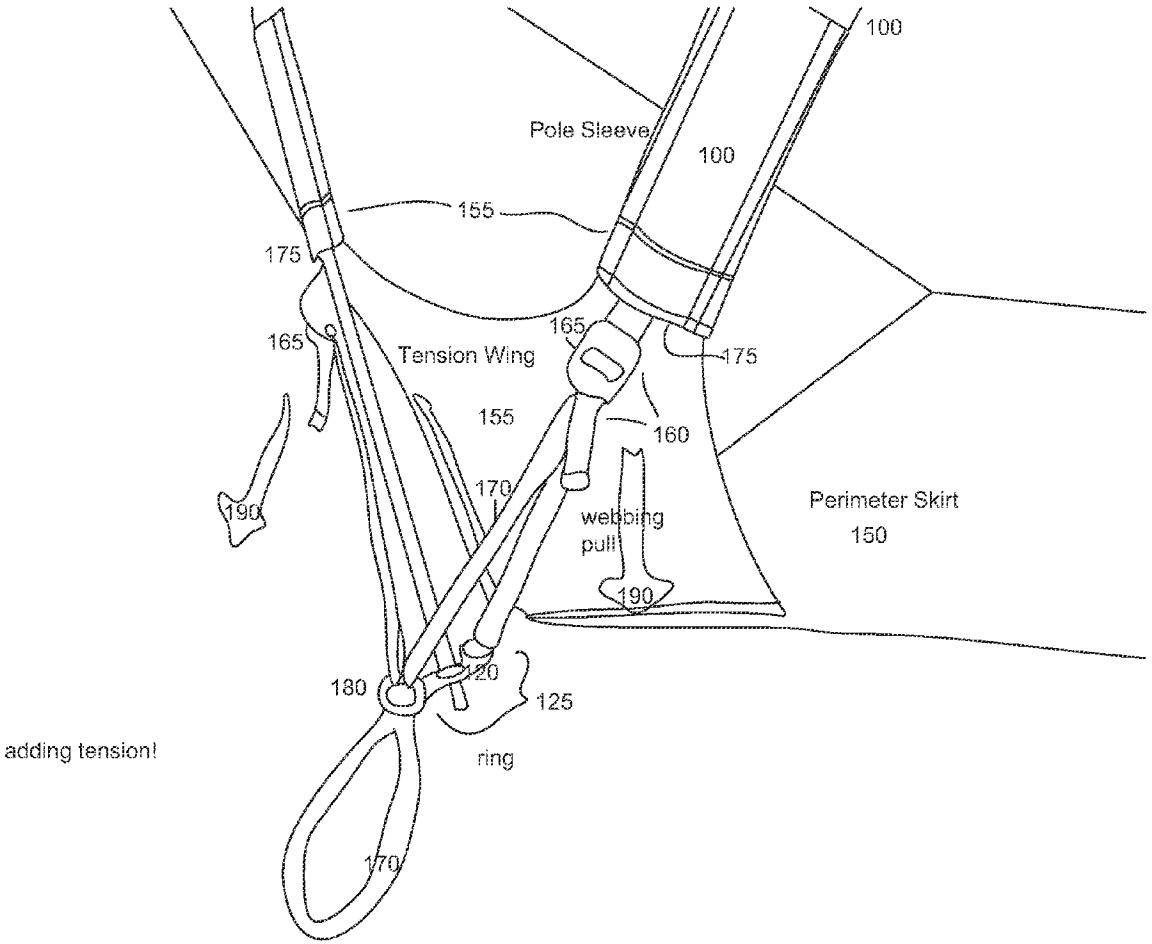
FIG. 7 illustrates one exemplary embodiment where the pole sleeves may be tightened for providing additional tension.

FIG. 7 illustrates one exemplary embodiment where the pole sleeves (and hence the corresponding web hubs coupled with the pole sleeves) may be tightened for providing additional tension (and hence additional strength) to the overall frame. In the illustrated embodiment, the web truss includes tent body grommet tab 125, grommets 120, webbing 170 loop, perimeter fabric skirt 150, tension wings 155, tensioning system 160 for the flexible hollow pole sleeve structure 100, pole sleeve opening 175, pole sleeve reinforcements 155 and o-ring 180. In the disclosed exemplary embodiment, the tensioning system 160 for the flexible hollow pole sleeve structure 100 comprises of a buckle 165 which is attached to or near the pole sleeve opening 175 and a webbing 170 strap that is affixed at one end to the o-ring 180, with the opposite end of the webbing 170 threaded through the tensioning buckle 165. In the illustrated embodiment, the tension of the flexible hollow pole sleeve structure 100 can be adjusted by pulling 190 on the webbing 170 strap as shown in FIG. 7. The amount of tension applied to the flexible hollow pole sleeve structure 100 may be adjusted based on the need for additional strength for extreme environmental conditions such as high wind or heavy snow loads. It is understood that the above description is merely one example of how the tensioning system may be applied to the web truss in order to enable control of tension applied to adjust and control the tension (and corresponding strength) of the frame of the improved tent assembly. For example, the arrangement of the o-ring, the webbing, the tensioning buckle, etc. may be altered with respect to the web truss and the sleeve structures as may be suited for a particular design or an application of the tent assembly. Other arrangements or provisions for providing a tensioning mechanism, as may be understood by people of ordinary skill in the art may also be used to substitute the illustrated tensioning mechanism.

Figure 8:
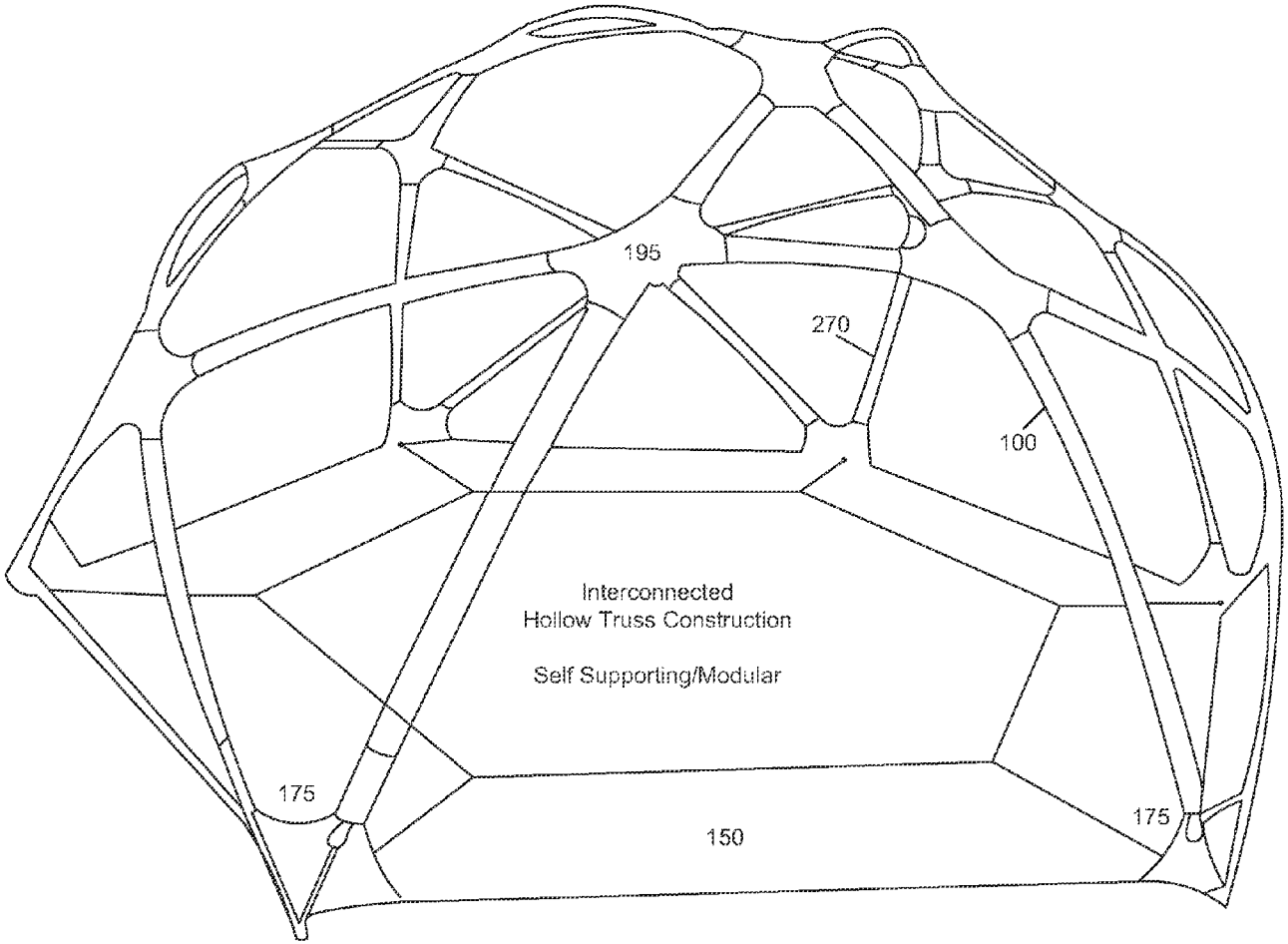
FIG. 8 depicts an embodiment of the improved tent assembly that specifically illustrates an example of a flexible hollow pole sleeve structure with 12 integral fabric hub intersections.

FIG. 8 depicts an embodiment of the improved tent assembly that specifically illustrates an example of a flexible hollow pole sleeve structure 100 with 12 integral fabric hub intersections 195. The flexible hollow pole sleeve structure 100 has an inner 270 flexible material layer and an outer 275 layer of flexible material. When joined, the inner and outer layers of material form the flexible hollow pole sleeve structure 100 with integral fabric hub intersections 195. The tent poles are fed into the flexible hollow pole sleeve structure 100 at any pole sleeve opening 175. The tent poles are located in-between the inner 270 flexible material layer and an outer 275 flexible material layer which form the flexible hollow pole sleeve structure 100.

Figure 9:
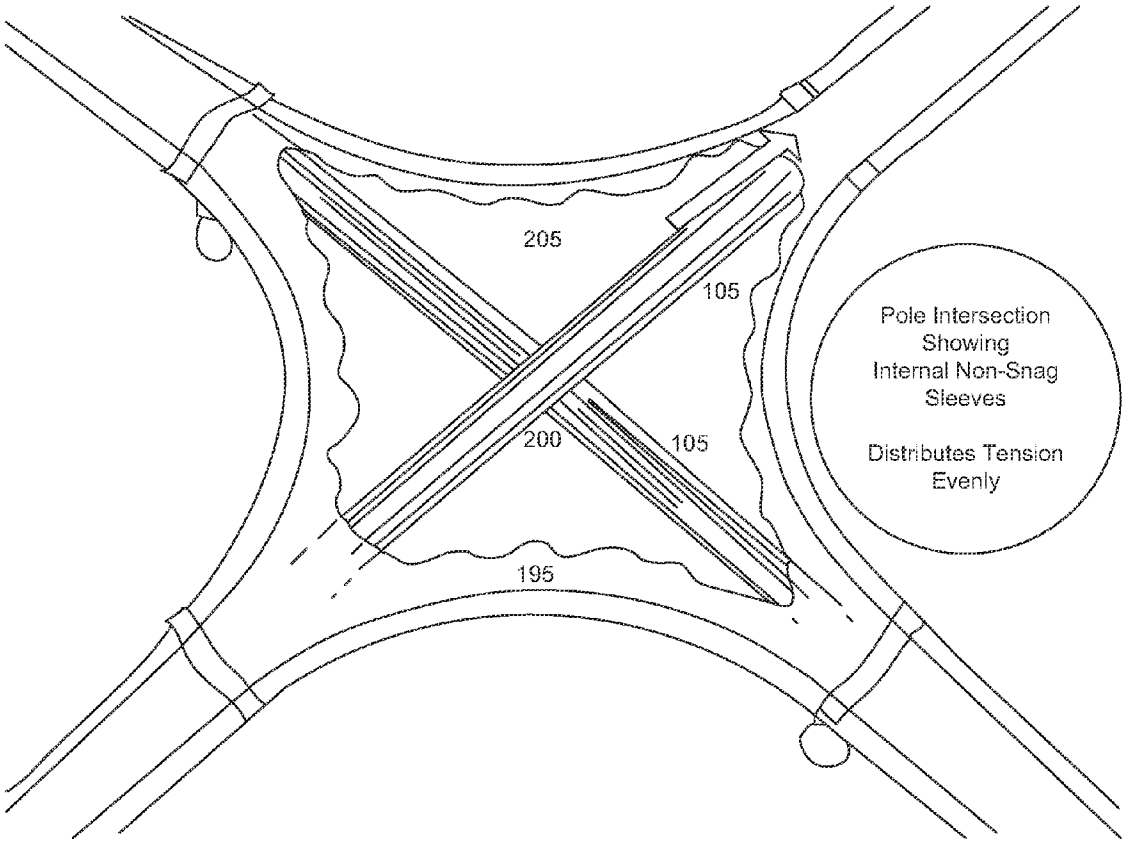
FIG. 9 illustrates one exemplary embodiment of a pole intersection point.
Figure 10:
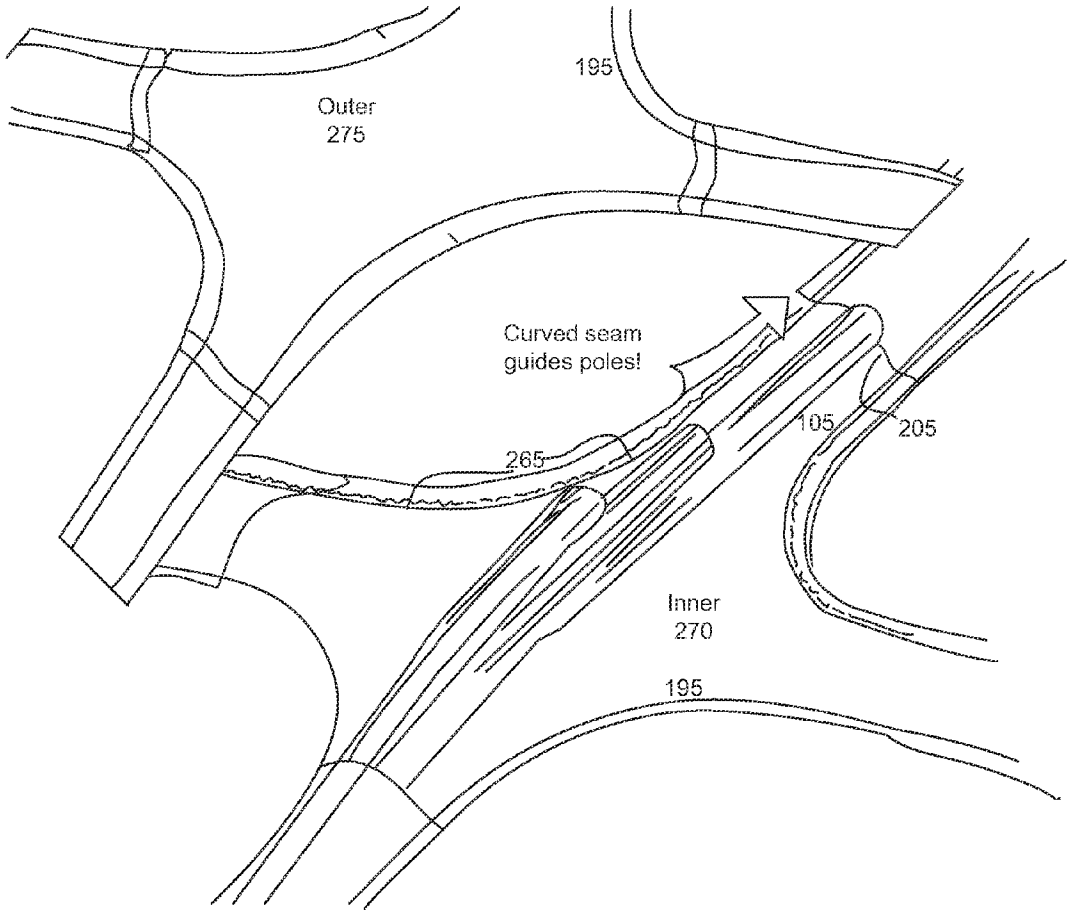
FIG. 10 illustrates an example of how a tent pole is automatically guided in the correct pole sleeve section inside the integral fabric hub intersections because of the curved shape of the integral fabric hub intersections.

FIG. 9 illustrates one exemplary embodiment of a pole intersection point 200. The integral fabric hubs 195 help guide the tent poles 105 in the correct direction without snagging or hanging up on another tent pole 105 or fabric. FIG. 10 illustrates an example of how a tent pole 105 is automatically guided in the correct pole sleeve section 205 inside the integral fabric hub intersections 195 because of the curved shape 265 of the integral fabric hub intersections 195. In the illustrated embodiment, the integral fabric hubs 195 can be cut on the straight of grain and eliminates bias stretch which helps increase the strength of the structure by holding the poles 105 more securely in place. FIG. 10 shows the outer 275 and inner 270 integral fabric hub intersections 195.

Figure 11:
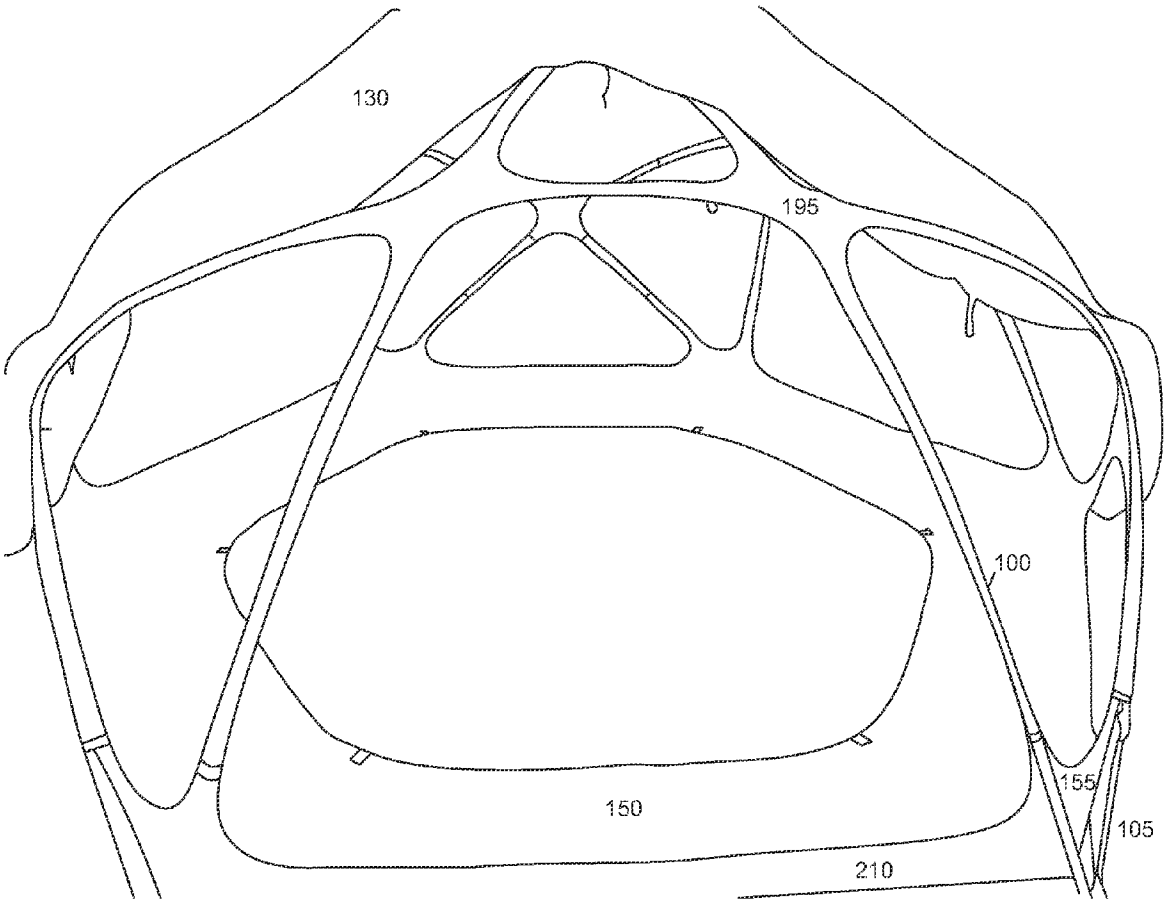
FIG. 11 illustrates an embodiment of a fully assembled flexible hollow pole sleeve structure with integral flexible material hub intersections, flysheet and tent poles.
Figure 12:
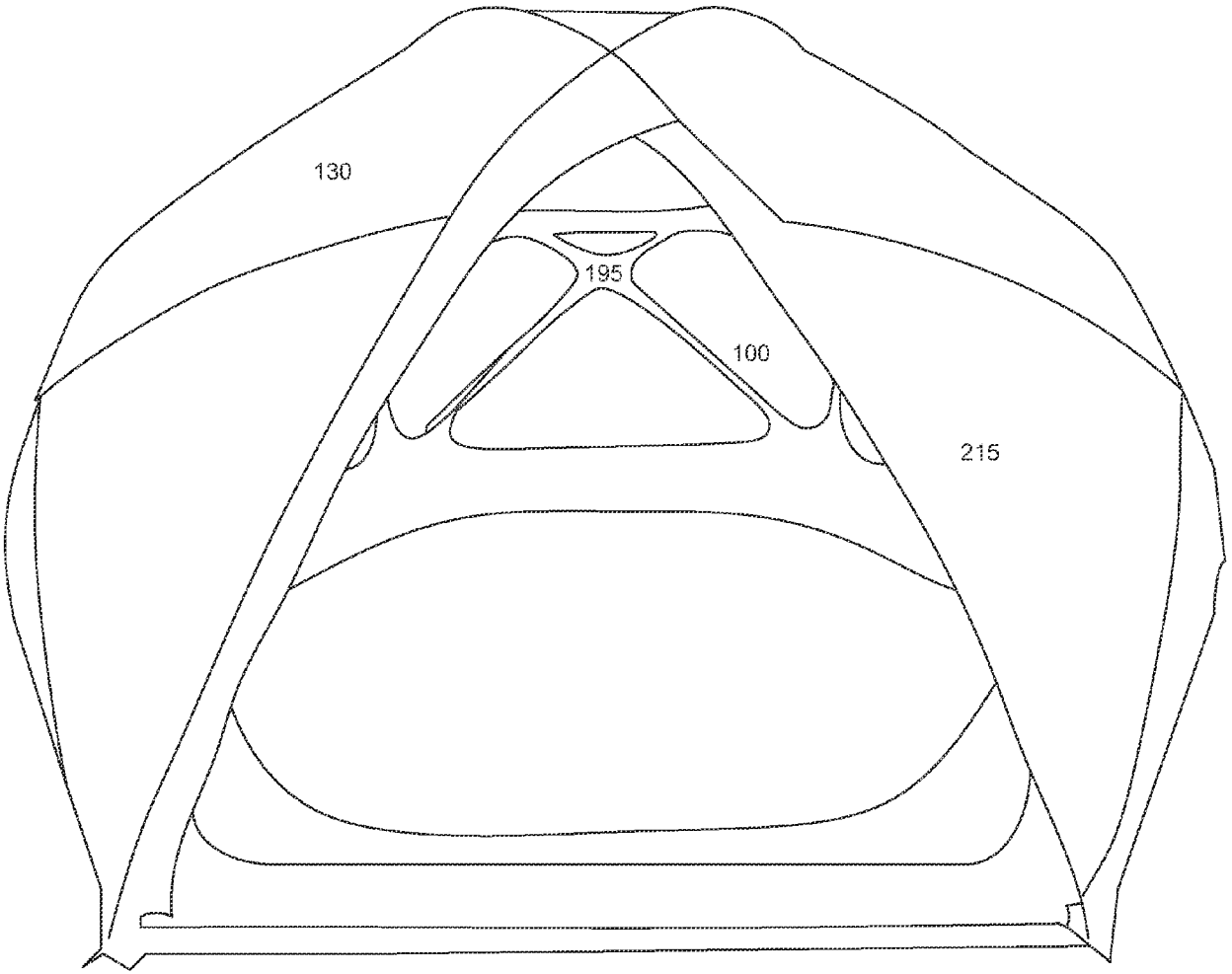
FIG. 12 further depicts an embodiment of a fully assembled flexible hollow pole sleeve structure with integral fabric hub intersections, flysheet, and tent poles with the flysheet door open.

FIG. 11 illustrates an embodiment of a fully assembled flexible hollow pole sleeve structure 100 with integral flexible material hub intersections 195, flysheet 130 and tent poles 105. In the illustrated embodiment, a perimeter skirt 150 is shown with a modified tension wing 155. The tension wings 155 have been connected to create a perimeter sidewall 210. The perimeter sidewall 210 helps keep wind blown snow, spindrift, rain, etc. from entering the tent assembly. FIG. 12 further depicts an embodiment of a fully assembled flexible hollow pole sleeve structure 100 with integral fabric hub intersections 195, flysheet 130 and tent poles with the flysheet door 215 open.

Figure 13:
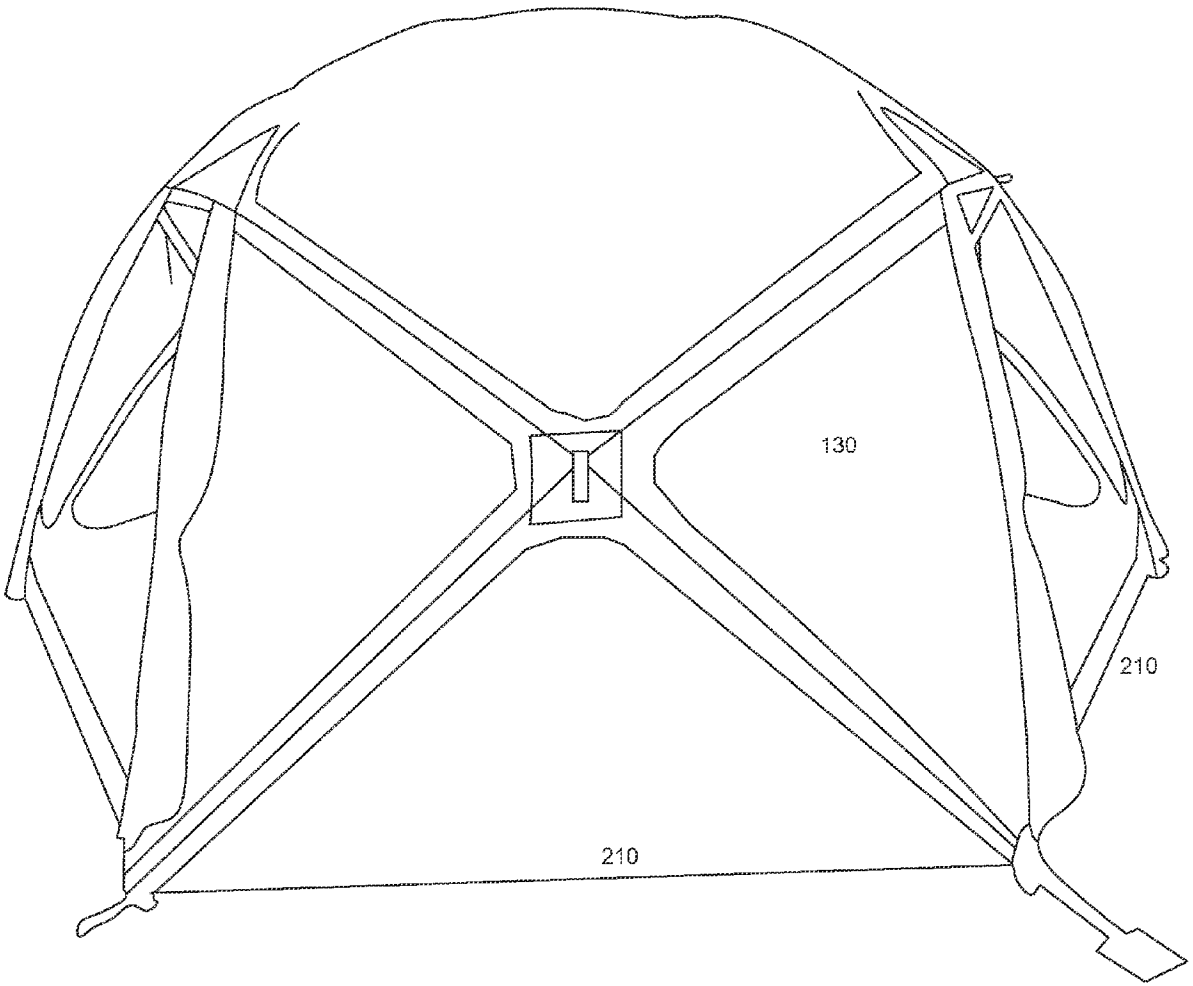
FIG. 13 illustrates the rear of the flysheet on an exemplary embodiment of a tent assembly.
Figure 14:
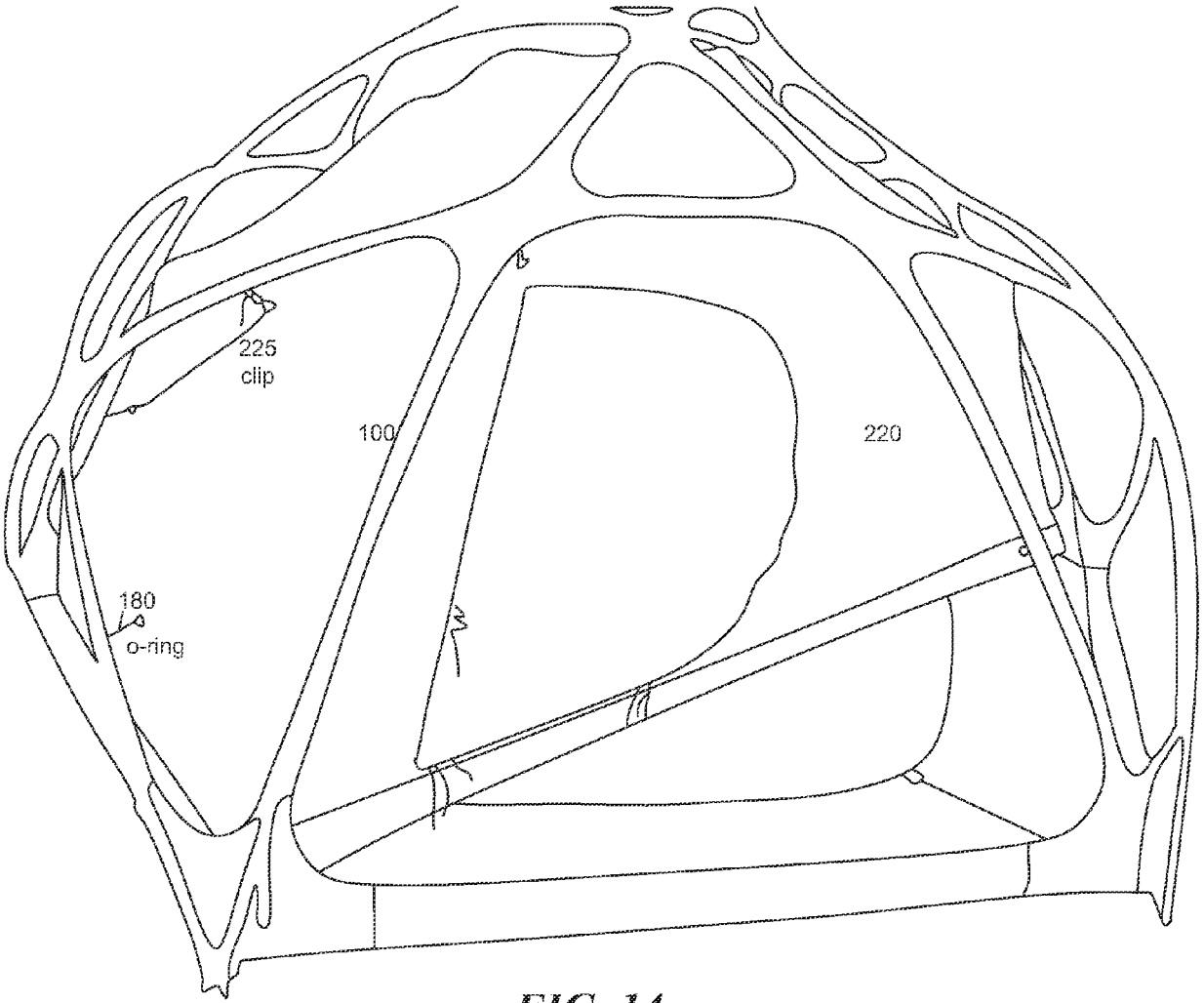
FIG. 14 illustrates a tent body affixed to the flexible hollow pole sleeve structure with clips.
Figure 15:
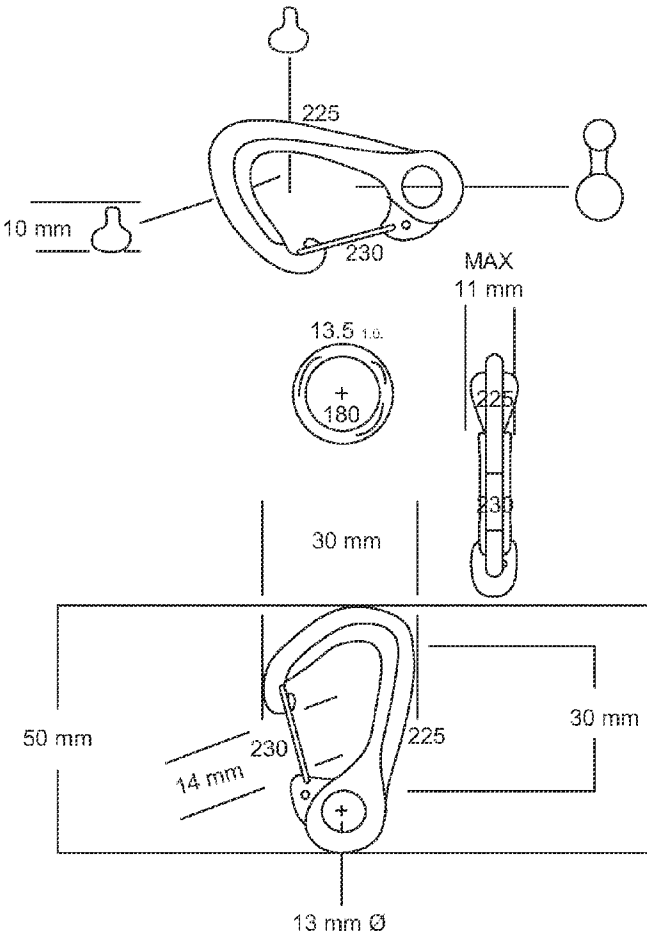
FIG. 15 illustrates a scenario where a plastic clip with a stainless steel gate is used for secure attachment to an o-ring.

FIG. 13 illustrates the rear of the flysheet 130 on an exemplary embodiment of a tent assembly. This embodiment further illustrates a perimeter sidewall 210. FIG. 14 illustrates a tent body 220 affixed to the flexible hollow pole sleeve structure 100 with clips 225. FIG. 15 illustrates a scenario where a plastic clip 225 with a stainless steel gate 230 is used for secure attachment to an o-ring 180. In embodiments, this protects the clips 225 from disengaging from the o-rings 180 when encountering, for example, high buffeting winds. In embodiments, the tent body 220 may be affixed to the flexible hollow pole sleeve structure 100 via clips, webbing, grosgrain, o-rings, quick links, carabineers, hooks or other temporary or permanent means as may be understood by a person of ordinary skill in the art.

Figure 16:
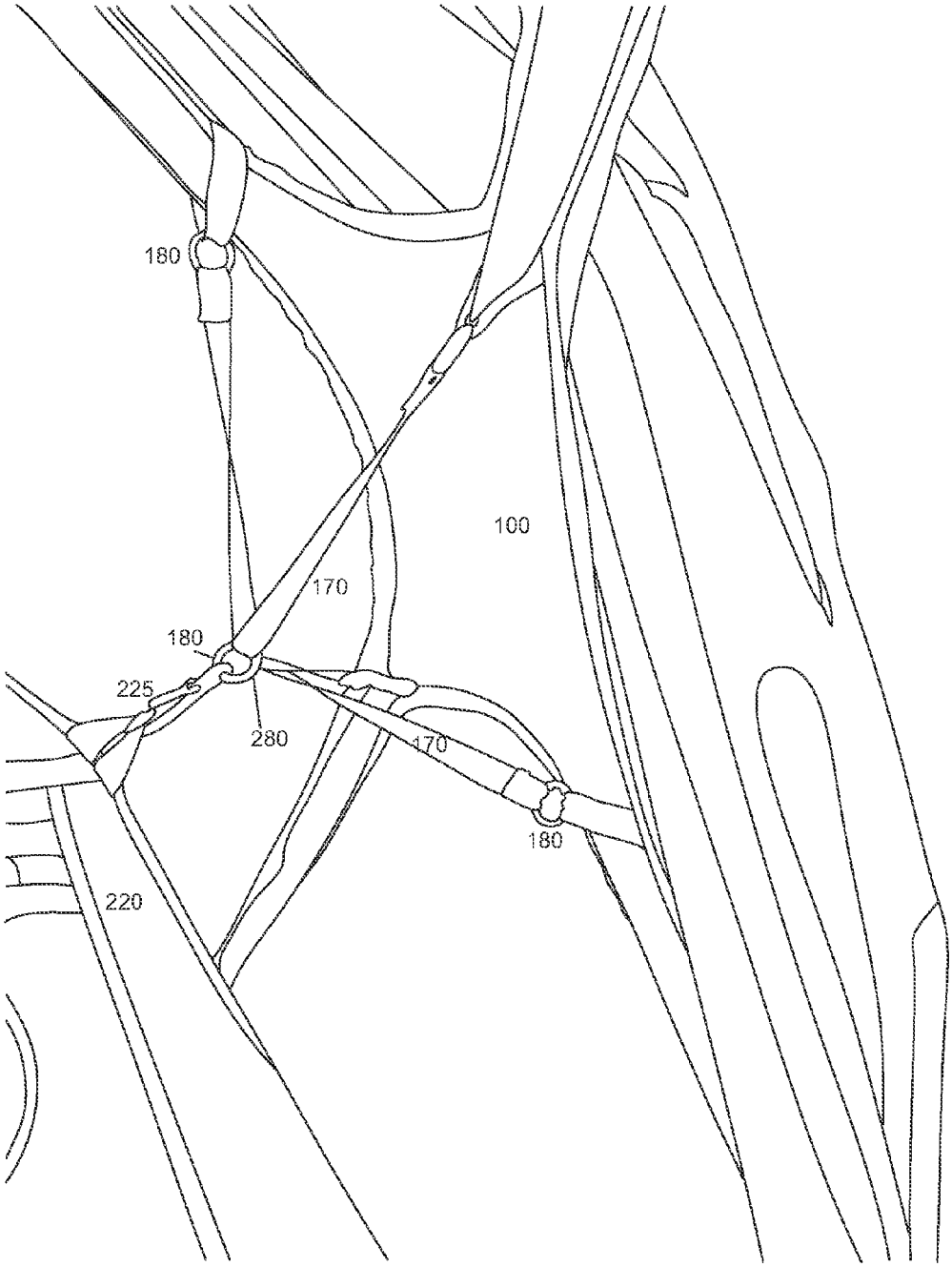
FIG. 16 illustrates an embodiment of the tent assembly with a different method of attaching the tent body.

FIG. 16 illustrates an embodiment of the tent assembly with a different method of attaching the tent body 220 to the o-rings 180 located on the flexible hollow pole sleeve structure 100. In embodiments, multiple webbing 170 straps are attached to a plurality of o-rings 180 that are attached to the webbing or a flexible material, which are turn is attached the flexible hollow pole sleeve structure 100. The clip 225 on the tent body 220 may then be attached to a single o-ring 280 on the flexible hollow pole sleeve structure 100.

Figure 17:
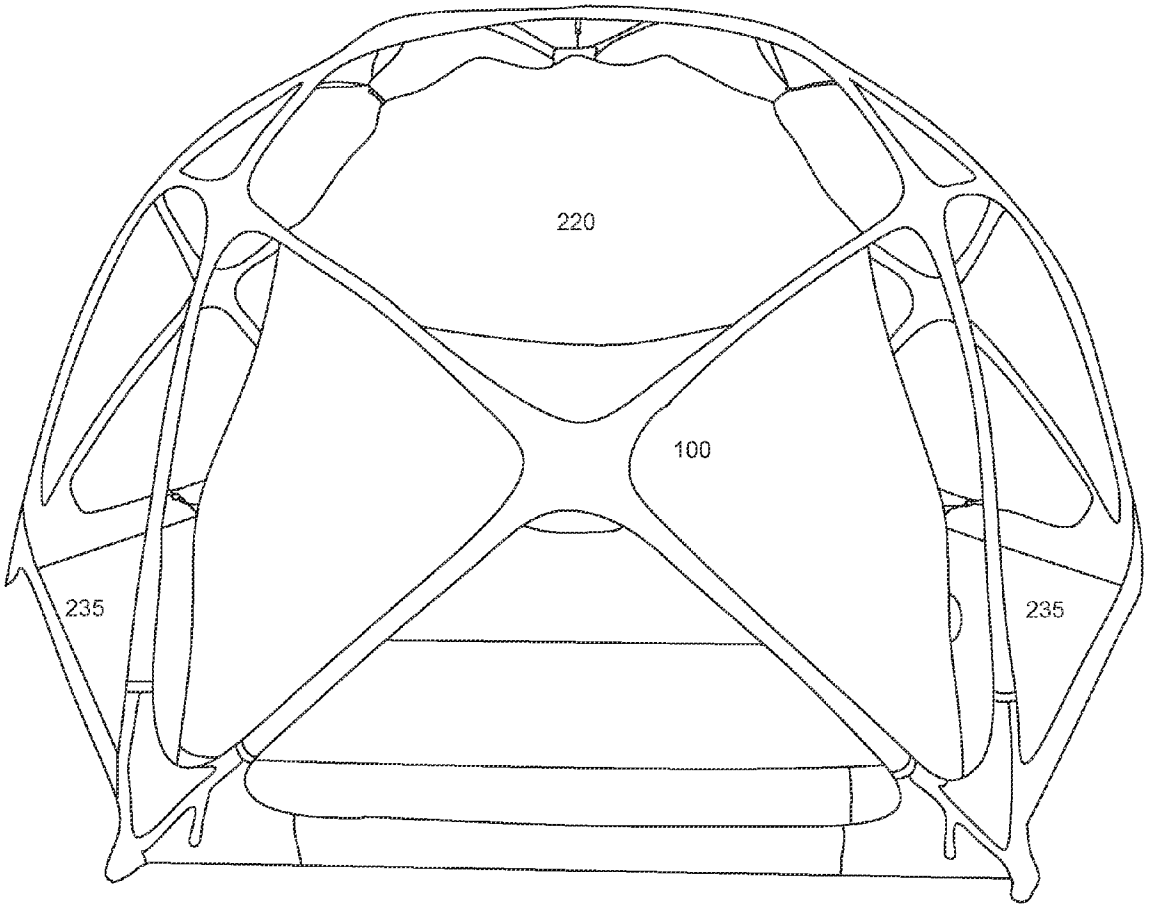
FIG. 17 shows an end view of an exemplary embodiment of a flexible hollow pole sleeve structure with an inner tent body.
Figure 18:
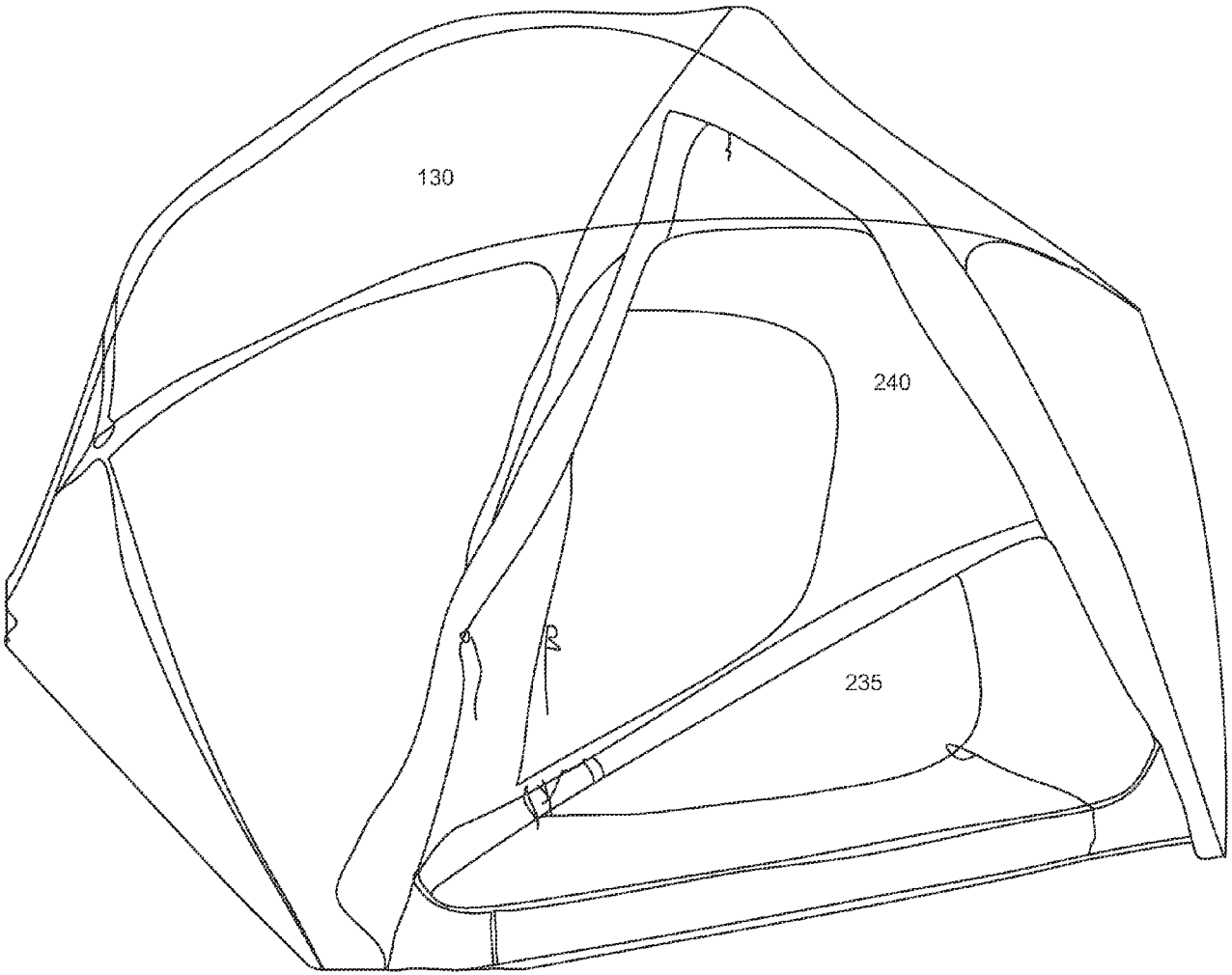
FIG. 18 shows the vestibule area inside the flysheet and in front of the tent door.
Figure 19:
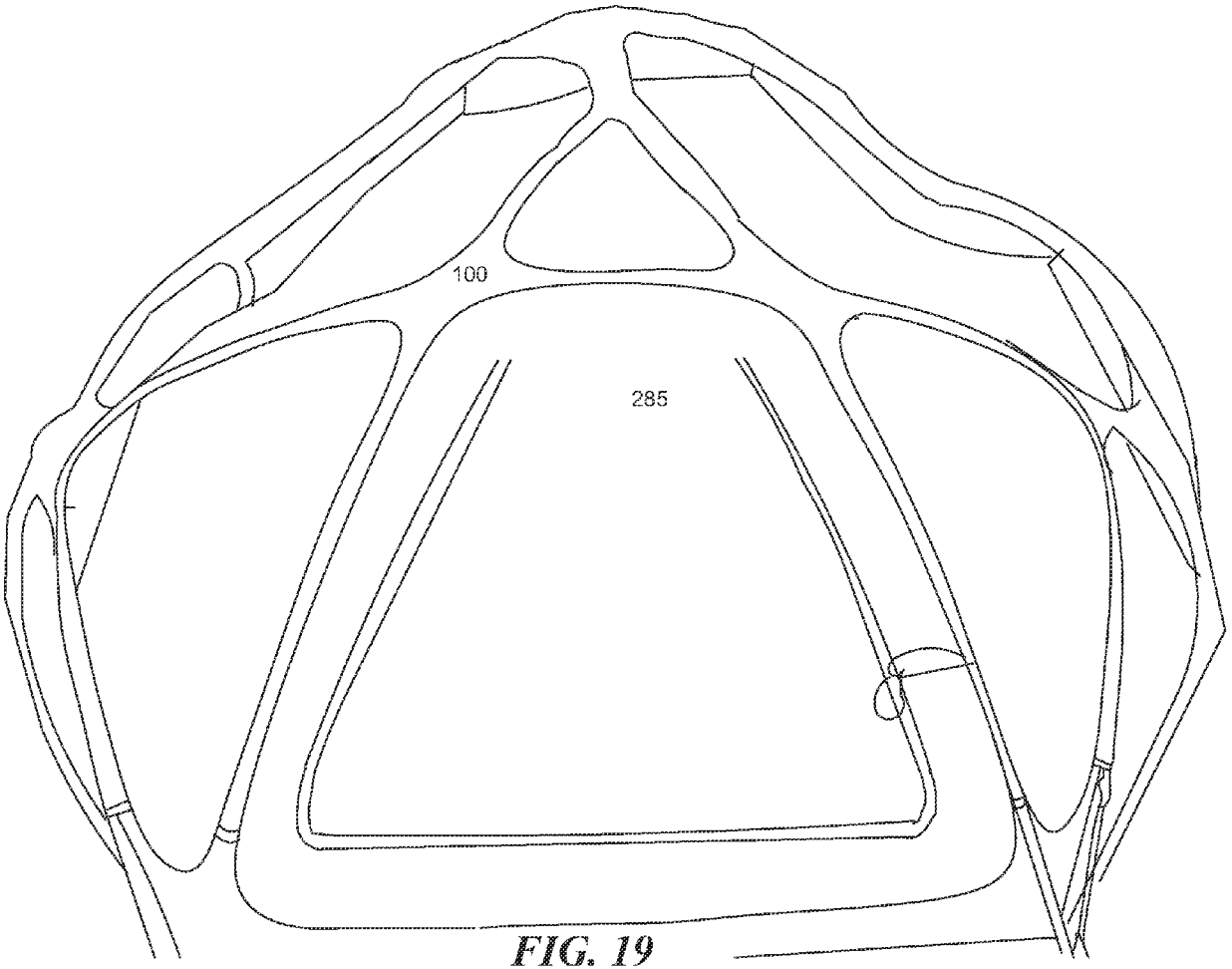
FIG. 19 illustrates a single wall tent with a waterproof coated fabric in combination with a flexible hollow pole sleeve structure.
Figure 20:
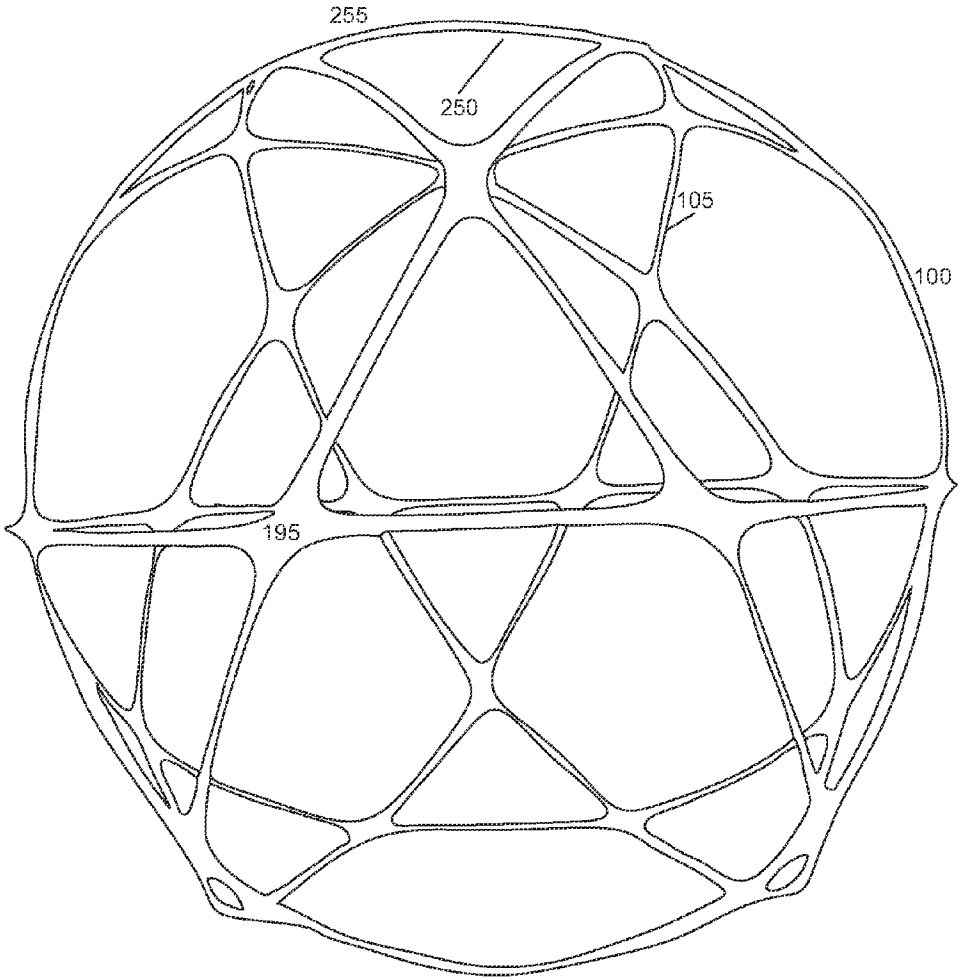
FIG. 20 illustrates flexible an exemplary embodiment of a hollow pole sleeve frame structure with integral fabric hub intersections that form of a sphere.

FIG. 17 shows an end view of an exemplary embodiment of a flexible hollow pole sleeve structure 100 with an inner tent body 220. In embodiments, the tent body 220 is shaped in such a manner as to create several vestibule areas 235 when the flysheet is engaged. FIG. 18 shows the vestibule area 235 inside the flysheet 130 and in front of the tent door 240. FIG. 19 illustrates a single wall tent 285 with a waterproof coated fabric in combination with a flexible hollow pole sleeve structure 100. This configuration is an example of a preferred structure for mountaineers. FIG. 20 illustrates flexible an exemplary embodiment of a hollow pole sleeve frame structure 100 with integral fabric hub intersections 195 that form of a sphere. In embodiments, the poles are connected at the terminal ends to form a continuous loop inside flexible hollow pole sleeve frame structure 100 to create the sphere structure. Here, in embodiments, the tent poles are inserted or removed via an opening 255 in a pole sleeve segment 250. The flexible hollow pole sleeve frame structure 100 can be tensioned as per the pole sleeve tensioning system illustrated in FIG. 7.

Figure 21:
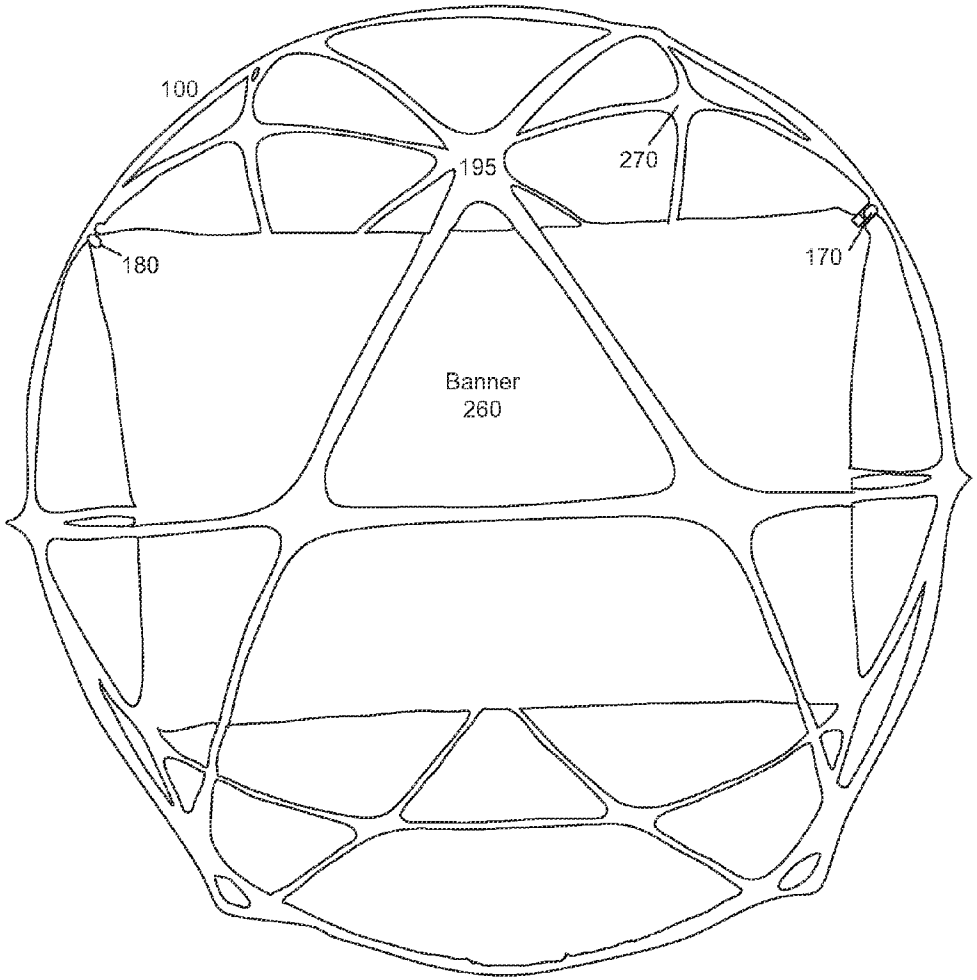
FIG. 21 illustrates an embodiment of an improved tent assembly where a display banner is attached from the interior of the flexible hollow pole sleeve frame structure.

FIG. 21 illustrates an embodiment of an improved tent assembly where a display banner 260 is attached from the interior of the flexible hollow pole sleeve frame structure 100 with integral fabric hub intersections 195. The display material may be held in place by o-rings 180 or webbing 170 loops located on the inner 270 layer of the flexible hollow pole sleeve frame structure 100.

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above" "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or sub-combinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

I claim:

1. A tent assembly, comprising:

a web truss configured to house a plurality of poles to create a frame for the tent assembly, wherein the web truss includes:

a plurality of pole sleeves, each of the plurality of pole sleeves allowing one of the plurality of poles to be slid through to create the frame for said tent assembly;

at least one web hub coupling at least two of the plurality of pole sleeves, wherein the at least one web hub comprises a first fabric coupled to a second fabric, and a region between the first fabric and the second fabric comprises an interior volume of the at least one web hub, wherein the first fabric and the second fabric of the at least one web hub are each uninterrupted by other fabric portions, and further wherein the interior volume of the at least one web hub is uninterrupted and contiguous to an interior volume of each of the at least two of the plurality of pole sleeves, and further wherein poles housed in the at least two of the plurality of pole sleeves touch and cross each other within the interior volume of the at least one web hub, wherein, the web truss is configured to enable each of the plurality of poles of the tent assembly to be continuously slid from one base of the tent assembly to another base of the tent assembly.

2. The tent assembly of claim 1, further comprising:

a tensioning system coupled with at least one of the plurality of pole sleeves, the tensioning system configured to add additional tension to an associated pole sleeve and a corresponding web hub by stretching the pole sleeve in a direction external to the frame of said tent assembly, wherein the tensioning system is for a user to optionally add or reduce tension added to a given pole sleeve.

3. The tent assembly of claim 2, wherein the tensioning system includes a sliding adjustor, the sliding adjustor enabling a user to adjust an amount of tension added to an associated pole sleeve.

4. The tent assembly of claim 1, wherein the first fabric and the second fabric of the at least one web hub is cut on the grain so as to reduce bias stretch and to increase strength of the at least one web hub.

5. The tent assembly of claim 4, wherein a given one of the at least one web hub includes angled hubways for guiding insertion and sliding of associated poles without colliding with each other.

6. The tent assembly of claim 4, wherein a tensioning system attached to a given pole sleeve is configured to alter a fabric tension associated with a corresponding web hub connected to the given pole sleeve to control a strength of the web hub to hold associated pole sleeves securely in place.

7. The tent assembly of claim 1, wherein an external covering over the frame of the tent assembly is provided by using:

a fly sheet configured to be optionally attached to the frame.

8. The tent assembly of claim 1, wherein the frame of the tent apparatus is independent and is configured separately from an optional fly sheet and an optional tent body.

9. The tent assembly of claim 1, wherein a tent body is affixed internal to the frame using fastening provisions provided in conjunction with the web truss for fastening the tent body.

10. The tent assembly of claim 1, wherein an external covering over the frame of the tent assembly is provided by using a fly sheet configured to be optionally attached to the frame, and a tent body configured to be optionally attached to the frame, and further wherein the tent assembly includes at least one vestibule area between the tent body and the fly sheet.

11. The tent assembly of claim 1, further wherein the length of each of the plurality of poles is identical.

12. The tent assembly of claim 1, further wherein the length of at least one of the plurality of poles is not identical to another pole of the plurality of poles.

13. A tent assembly comprising:

a plurality of pole sleeves located on a web truss, each of the pole sleeves configured to receive a pole of a plurality of poles for creating a three-dimensional frame for the web truss;

at least one web hub located on the web truss, coupling at least two of the plurality of pole sleeves, wherein the at least one web hub comprises an outer hub fabric and an inner hub fabric, and a region between the outer hub fabric and the inner hub fabric comprises an interior volume of the at least one web hub, and the outer hub fabric and the inner hub fabric are each uninterrupted by other fabric sections, and further wherein an interior volume of the at least one web hub is uninterrupted and contiguous to an interior volume of each of the at least two of the plurality of pole sleeves, and further wherein poles positioned in the at least two of the plurality of pole sleeves touch and cross each other within the interior volume of the at least one web hub.

14. The tent assembly of claim 13, further comprising a tensioning system coupled to at least one of the plurality of pole sleeves and configured to change an amount of tension to the at least one of the plurality of pole sleeves and one or more corresponding hubs coupled to the at least one of the plurality of pole sleeves.

15. The tent assembly of claim 14, wherein the amount of tension is adjustable by a user.

16. The tent assembly of claim 13, further comprising a fly sheet configured to be optionally attached to the frame.

17. The tent assembly of claim 13, further comprising a tent body configured to be optionally attached to the frame.

18. The tent assembly of claim 17, wherein the tent body is affixed to the frame within the tent assembly using means for fastening.

19. The tent assembly of claim 13, further comprising a fly sheet configured to be optionally attached to the frame, and a tent body configured to be optionally attached to the frame.

* * * * *